US006149335A

United States Patent [19]

Smith

[11] Patent Number: 6,149,335

[45] Date of Patent: Nov. 21, 2000

[54] SEAL FOR A PEN REFILL SYSTEM AND A METHOD FOR USING THE SAME

[76] Inventor: Paul A. Smith, 2311 Mohawk La., Glenview, Ill. 60025

[21] Appl. No.: 09/334,868

[22] Filed: Jun. 17, 1999

[51] Int. Cl.[7] ..... B43K 7/08; B43K 23/12

[52] U.S. Cl. ..... 401/209; 401/213

[58] Field of Search ..... 401/209, 213, 401/243, 246, 247

[56] References Cited

U.S. PATENT DOCUMENTS

| | | | |
|---|---|---|---|
| D. 319,662 | 9/1991 | Henry | 401/213 |
| 631,824 | 8/1899 | Robinson | 401/247 |
| 634,013 | 10/1899 | Mitchell | 401/243 |
| 1,423,448 | 7/1922 | O'Connor | 401/213 |
| 3,346,100 | 10/1967 | Carlson | 401/209 |
| 5,308,179 | 5/1994 | Whitright | 401/209 |

FOREIGN PATENT DOCUMENTS

| | | | |
|---|---|---|---|
| 2706951 | 8/1978 | Germany | 401/213 |

*Primary Examiner*—Charles R. Eloshway
*Attorney, Agent, or Firm*—Patents & TMS, P.C.

[57] ABSTRACT

A seal that attaches to a pen cap, a sealable pen refill system and a method of using the same are provided. The seal fits over an end of the pen refill cap. The pen refill cap and the seal then fit over a tip of the pen refill compartment acting as a seal to elements such as air and moisture.

18 Claims, 1 Drawing Sheet

SEAL FOR A PEN REFILL SYSTEM AND A METHOD FOR USING THE SAME

BACKGROUND OF THE INVENTION

The present invention generally relates to a cap for a pen refill. More specifically, the present invention relates to a seal for attachment to a cap of a pen refill that provides an air-tight compartment in which the tip of a pen refill extends. In addition, the present invention relates to a method for using the same.

It is, of course, generally known to provide caps for pens, pen refills, or the like. A pen or pen refill typically contains a compartment having a quantity of ink therein having an opening at a tip at an end of the compartment through which ink may flow. Caps are often provided for both pen caps and pen refills for many reasons. Those reasons include preventing ink at the opening of the compartment from drying or being otherwise damaged and preventing incidental contact of the ink with items not intended to be contacted by the ink.

However, typical pen caps or pen refill caps do not provide adequate protection against air or moisture. This is particularly problematic with regard to certain types of ink. Certain inks, by exposing the ink to air, are dried out and often depleted. Further, moisture in the atmosphere may damage the chemical composition of the ink thereby degrading the quality of the ink. On a consumer level, this can be particularly problematic. In some instances, a new pen or pen refill may be purchased by a consumer or other individual that is completely depleted of ink due to exposure of the tip to air that rapidly dries and depletes the ink.

A need, therefore, exists for an improved seal and a pen or pen refill cap system containing the seal that protects the ink in the pen or pen refill from drying or being further damaged. Further, a need exists for a method of using the same to overcome the deficiencies of that which is presently available and/or implemented.

SUMMARY OF THE INVENTION

The present invention provides a seal that may be attached to a pen or pen refill compartment or cap. The invention further provides a system including the seal and pen or pen refill and cap. Further, the invention includes a method for using the same.

To this end, in an embodiment of the present invention, an apparatus is provided. The apparatus has a seal that has a body defined between a first end and a second end wherein the first end has a first opening therein and further wherein the second end has a second opening therein. A pen refill cap is attached within the first opening of the seal.

In an embodiment, the first opening of the seal is circular.

In an embodiment, the second opening of the seal is circular.

In an embodiment, the first end of the seal sealingly engages the pen refill cap.

In an embodiment, the seal is plastic.

In an embodiment, the seal is rubber.

In an embodiment, the second opening of the seal is smaller than the first opening.

In another embodiment of the present invention, a pen refill system is provided. The system has a seal having a body defined between a first end and a second end wherein the first end has a first opening therein and the second end has a second opening therein. A pen refill cap is sealingly engaged to the seal wherein the pen refill cap fits within the first opening of the seal. A pen refill compartment has an interior containing ink therein removably attached and sealingly engaged to the seal wherein the pen refill compartment fits within the second opening of the seal.

In an embodiment, the first and second openings of the seal are circular.

In an embodiment, the pen refill compartment has a tip wherein the tip fits within the pen refill cap.

In an embodiment, the pen refill compartment has a tip with a base. The base of the tip sealingly engages the second end of the seal when the seal is fit over the base of the tip.

In an embodiment, the seal is plastic.

In an embodiment, the seal is rubber.

In an embodiment, the pen refill cap has a first end that fits within the first opening of the seal.

In an embodiment, the second opening of the seal is smaller than the first opening of the seal.

In an embodiment, the pen refill compartment has a first end. The seal sealingly attaches to the pen refill cap and the pen refill cap and O-ring together fit over and sealingly engage the first end of the pen compartment.

In another embodiment of the present invention, a method of making and using a sealed pen refill system is provided. The method comprises the steps of: providing a pen refill cap, a seal having a body defined between a first end and a second end wherein the first end has a first opening therein and the second end has a second opening therein and a pen refill compartment having an interior containing ink therein; attaching the seal to the pen refill cap; and sealingly engaging the seal to the pen refill compartment.

In an embodiment, a tip is provided on an end of the pen refill compartment wherein the pen refill cap fits over the tip of the pen refill compartment.

In an embodiment, the pen refill cap is removed from the pen refill compartment.

In an embodiment, the pen refill cap is removed and the pen refill compartment is used as a writing instrument.

It is, therefore, an advantage of the present invention to provide a seal apparatus, a system and a method for a pen, a pen refill compartment or a cap.

Another advantage of the present invention is to provide a seal apparatus, a system and a method that seals a pen tip on an end of a pen refill compartment within a pen refill cap.

Yet another advantage of the present invention is to provide a seal apparatus, a system and a method to protect ink capable of flowing through a pen tip from moisture.

A still further advantage of the present invention is to provide a seal apparatus, a system and a method to prevent air from drying out ink contained in a pen or a pen refill.

Further, an advantage of the present invention is to provide a seal apparatus, a system and a method to prevent moisture from damaging ink contained in a pen or pen refill.

Moreover, an advantage of the present invention is to provide a seal apparatus, a system and a method to prevent light from damaging or drying ink contained in a pen or pen refill tip.

A still further advantage of the present invention is to provide a seal apparatus, a system and a method whereby the seal is attached to a pen, a refill or a pen refill cap.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a seal for a pen refill system. The seal provides protection of the ink from certain elements, such as air and water. The present invention further provides a method for sealing a pen refill by attaching a seal to a pen refill cap.

Figure 1:
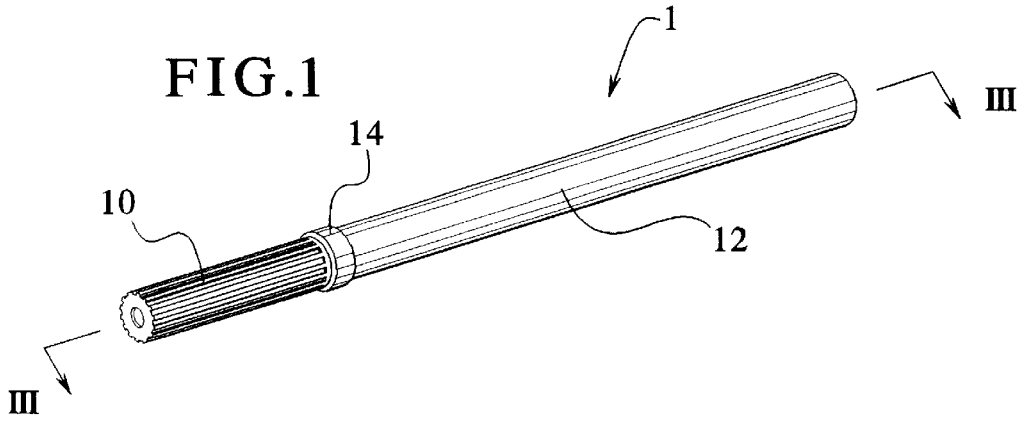
FIG. 1 illustrates a perspective view of an embodiment of a seal engaged to a pen refill.

Referring now to FIG. 1, a sealed pen refill system 1 is illustrated. The sealed pen refill system 1 allows a pen refill to last for extended periods of time without drying, damaging, depleting or otherwise destroying ink contained therein. The pen refill may be placed inside of a pen casing and used as a writing instrument. Alternatively, the pen refill itself may be used as a writing instrument. The sealed pen refill system 1 may have a cap 10 and a pen refill compartment 12. The pen refill cap 10 may be hollow to provide an interior compartment for the pen refill compartment 12 to fit therein. Disposed between the pen refill cap 10 and the pen refill 12 is a seal 14 that acts as a barrier to air and/or water entering the pen refill cap 10.

Figure 2:
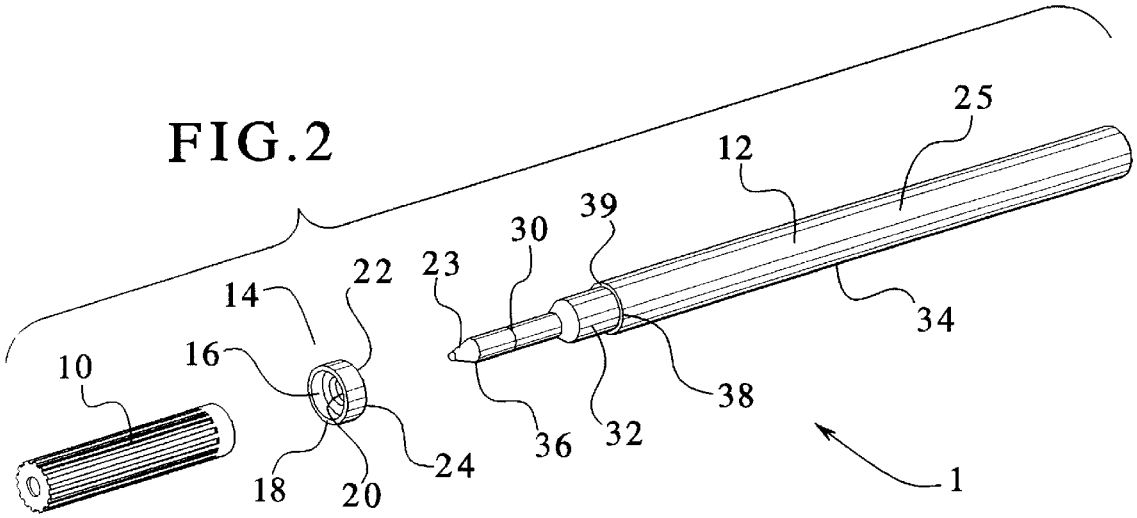
FIG. 2 illustrates a perspective view of a pen refill cap, a seal and a pen refill compartment.
Figure 3:
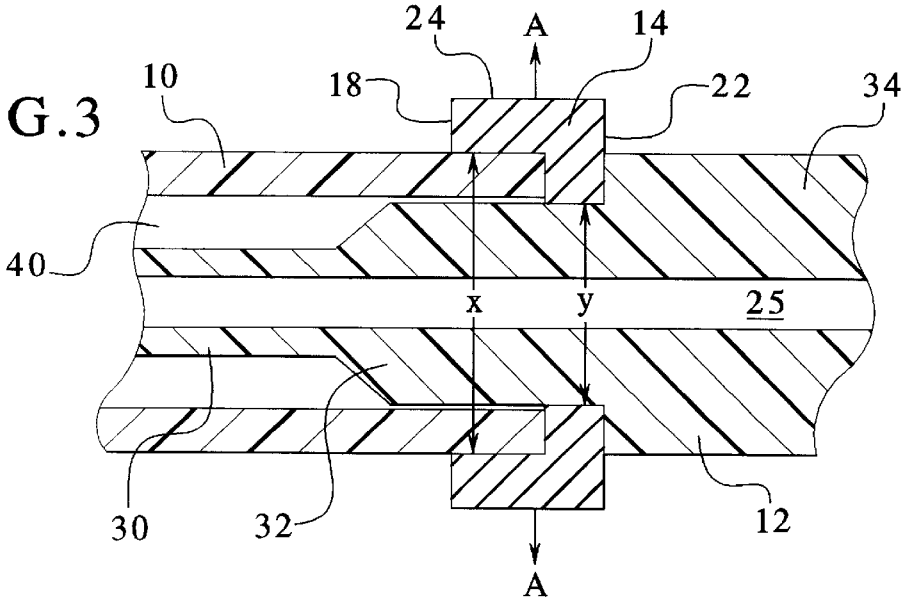
FIG. 3 illustrates a cross-sectional view of an embodiment of a seal of the present invention as attached to a refill cap and a pen refill compartment.

FIG. 2 illustrates a perspective view of the pen refill system 1 wherein each component is separated from the other. The seal 14 may have a first opening 16 in a first end 18 of the seal 14. A second opening 20 may be contained within a second end 22 disposed opposite the first end 18 of the seal 14. A side wall 24 is disposed and integrally formed between the first end 18 and the second end 22 of the seal 14. The diameter x of the first opening 16 is greater than the diameter y at the second opening 20. The opening 16 is large enough to surround the end of the cap 10 as illustrated in FIG. 3.

The seal 14 may be constructed of any material that provides a seal when used in the pen refill system 1. Rubber is the preferred material to be used, but the invention is not to be construed as limited in any way with respect to the material used for the seal 14. Other materials, such as plastic, may be utilized in the invention and will be apparent to those skilled in the art.

The pen refill cap 10 may fit within the first opening 16 of the seal 14. Preferably, the seal 14 attaches to the pen refill cap 10 and remains attached when the pen refill cap 10 is removed from the pen refill compartment 12.

The pen refill compartment 12 has a tip 23 disposed on an end 36 of the pen refill compartment 12. The tip 23 is a point through which ink 25 contained in the pen refill compartment 12 flows for use in writing with the pen refill compartment 12 after typically inserting the same into a body of a pen, for example. The tip 23 allows the ink 25 contained within the pen refill compartment 12 to flow therefrom, allowing the pen refill compartment 12 to be utilized as a writing instrument. The refill compartment 12 further has a shaft 30 and a base 32. The shaft 30 is disposed between the tip 23 and the base 32. The base 32 may be connected to a remainder 34 of the pen refill compartment 12. The tip 23 and the remainder 34 of the pen refill compartment 12 may be integrally formed as a single piece or may be separately formed and sealingly attached together.

In use, after the pen refill cap 10 is attached to the seal 14 inside the first opening 16 of the seal 14, the pen refill cap 10 and the seal 14 are attached to the pen refill compartment 12. The second opening 20 of the seal 14 may attach to the pen refill compartment 12 by fitting over the base 32 of the tip 23. An end 38 of the remainder 34 of the pen refill compartment 12 provides a ledge 39 that acts as a stopper for the pen refill cap 10 and seal 14 as the pen refill cap 10 and the seal 14 fit over the tip 23 of the pen refill compartment 12.

FIG. 3 illustrates a cross-sectional view of the pen refill system 1 and shows how the pen refill cap 10, the pen refill compartment 12 and the seal 14 engage one another thereby creating an air-tight seal.

The pen refill cap 10 fits into the seal 14 through the first opening 16 of the first end 18. The pen refill cap 10 may be inserted into the first opening 16 of the first end 18 of the seal 14 up to the point A as illustrated in FIG. 3. The first opening 16 is just large enough to fit over an end of the pen refill cap 10.

After the seal 14 is attached to the pen refill cap 10, the tip 23 of the pen refill compartment 12 may be inserted into an inside compartment 40 of the pen refill cap 10 through the second opening 20 of the second end 22 of the seal 14. The second opening 20 may be just large enough to fit over the base 32. The pen refill compartment 12 may be inserted into the pen refill cap 10 until the ledge 39 is reached. Upon insertion of the tip 23 of the pen refill compartment 12 into the pen refill cap 10 through the seal 14, the tip 23 is sealed to moisture and air. The seal 14 may create an air-tight barrier between the pen refill cap 10 and the pen refill compartment 12, thereby effectively sealing the tip 23 of the pen refill compartment 12 from air and/or moisture.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An apparatus for enclosing a tip of a refill for a writing instrument, the apparatus comprising:

a seal having a body defined between a first end and a second end wherein the first end has a first opening therein and further wherein the second end has a second opening therein which is smaller than the first opening and forms a stop at the bottom of the first opening, the seal further having an interior wall and an exterior wall wherein the interior wall is substantially parallel to the exterior wall; and a pen refill cap sealingly engaged within the first opening of the seal in contact with the interior wall of the seal and the stop wherein the cap encloses the tip of the refill for the writing instrument.

2. The apparatus of claim 1 wherein the first opening of the seal is circular.

3. The apparatus of claim 1 wherein the second opening of the seal is circular.

4. The apparatus of claim 1 wherein the first end of the seal sealingly engages the pen refill cap.

5. The apparatus of claim 1 wherein the seal is plastic.

6. The apparatus of claim 1 wherein the seal is rubber.

7. A pen refill system comprising:

a seal having a body defined between a first end and a second end wherein the first end has a first opening therein and further wherein the second end has a second opening therein which is smaller than the first opening and forms a stop at the bottom of the first opening, the seal further having an interior wall and an exterior wall wherein the interior wall is substantially parallel to the exterior wall;

a pen refill cap sealingly engaged to the seal wherein the pen refill cap is positioned within the first opening of the seal in contact with the interior wall of the seal and the stop; and a pen refill compartment having an interior containing ink therein removably attached and sealingly engaged to the seal wherein the pen refill compartment is positioned within the second opening of the seal in contact with the interior wall of the seal.

8. The system of claim 7 wherein the first and second openings of the seal are circular.

9. The system of claim 7 wherein the pen refill compartment has a tip wherein the tip fits within the pen refill cap.

10. The system of claim 7 wherein the pen refill compartment has a tip with a base and further wherein the base of the tip sealingly engages the second end of the seal when the seal is fit over the base of the tip.

11. The system of claim 7 wherein the seal is plastic.

12. The system of claim 7 wherein the seal is rubber.

13. The system of claim 7 wherein the pen refill cap has a first end that fits within the first opening of the seal.

14. The system of claim 7 wherein the pen refill compartment has a first end and further wherein the seal sealingly attaches to the pen refill cap and the pen refill cap and seal together fit over and sealingly engage the first end of the pen refill compartment.

15. A method of making and using a sealed pen refill system, the method comprising the steps of:

providing a pen refill cap, a seal having a body defined between a first end and a second end wherein the first end has a first opening therein and the second end has a second opening therein which is smaller than the first opening and forms a stop at the bottom of the first opening, the seal further having an interior wall and an exterior wall, and a pen refill compartment having an interior containing ink therein;

attaching the seal to the pen refill cap wherein the pen refill cap has a first end that fits within the first opening of the seal in contact with the interior wall of the seal and the stop; and sealingly engaging the seal to the pen refill compartment wherein the pen refill compartment fits within the second opening of the seal in contact with the interior wall of the seal.

16. The method of claim 15 further comprising the step of:

providing a tip on an end of the pen refill compartment wherein the pen refill cap fits over the tip of the pen refill compartment.

17. The method of claim 16 further comprising the step of:

removing the pen refill cap from the pen refill compartment.

18. The method of claim 16 further comprising the steps of:

removing the pen refill cap; and using the pen refill compartment as a writing instrument.

* * * * *